United States Patent [19]

Toffolon

[11] Patent Number: 4,482,126

[45] Date of Patent: Nov. 13, 1984

[54] UNIVERSAL MULTI-PART FORM FOR CASTING CONCRETE PARAPETS

[76] Inventor: Roger L. Toffolon, 953 SE. MacArthur Blvd., Stuart, Fla. 33494

[21] Appl. No.: 421,963

[22] Filed: Sep. 23, 1982

[51] Int. Cl.[3] ..... B28B 7/04

[52] U.S. Cl. ..... 249/159; 249/158

[58] Field of Search ..... 249/155, 158, 159

[56] References Cited

U.S. PATENT DOCUMENTS

| | | | |
|---|---|---|---|
| 820,759 | 5/1906 | Besser | 249/155 |
| 896,330 | 8/1908 | Scheelky | 249/158 |
| 3,049,769 | 8/1962 | Schultz | 249/157 |
| 4,159,100 | 6/1979 | Landowski | 249/158 |

*Primary Examiner*—Donald Czaja
*Assistant Examiner*—Mary A. Becker
*Attorney, Agent, or Firm*—McCormick, Paulding & Huber

[57] ABSTRACT

A universal multi-part form for casting concrete parapets and the like having front and rear surfaces and opposite side and end surfaces with the dimensions between end surfaces varying between parapets. The form comprises a stationary base and support means which has a horizontal upwardly exposed surface for forming a front parapet surface. A first or base end surface form member is mounted on the stationary base and has an upright inner surface shaped in accordance with the parapet base contour. Similar but opposite side surface form members are elongated and slidably mounted on the base with inner surfaces conforming to the desired side surfaces of the parapets. A second or top end surface form member is supported by the base and connected at opposite ends with the side members for adjustable movement therewith. Connections between the top form member and the side form members accommodate movement of the three members in unison with the top member parallel with the base form member or in angular relationship therewith for parapets with inclined top surfaces. Thus, parapets with varying end-to-end or top-to-bottom dimensions can be accommodated and parapets with inclined top surfaces can be cast as desired.

10 Claims, 5 Drawing Figures

UNIVERSAL MULTI-PART FORM FOR CASTING CONCRETE PARAPETS

BACKROUND OF THE INVENTION

Precast concrete structural units known as DOUBLEWAL units have gained increasing commercial acceptance in recent years. DOUBLEWAL units have similar front and rear panels connected by a pair of spaced connecting arms and the units are stacked in staggered relationship in the construction of highway retaining walls and the like. Retaining walls so constructed have both functional and economic advantages.

When an uppermost course of DOUBLEWAL units or the like have been positioned atop a retaining wall, it is often necessary or desireable to provide a further course of parapet units for functional or decorative purposes. The parapets are generally single wall units which extend upwardly in the plane of the front walls or panels of the DOUBLEWAL or like units and which may terminate in a horizontal top surface or, in the case of a retaining wall of non-uniform height, the parapets may be required to have an inclined top surface. Further, parapets of varying height, or top-to-bottom dimension are often required for functional or aesthetic purposes even when the top surface of each parapet may be horizontal or parallel with the bottom surface thereof.

In view of the foregoing, and in the production casting of modular retaining wall units and the like, it will be obvious that a universal form is desireable in the casting of parapets. That is, a form capable of accommodating parapets having various top-to-bottom dimensions, inclined top surfaces, and varying overall configurations is essential if high production rates are to be attained at the casting plant in order to retain the economic advantage of modular retaining walls as contrasted with conventional poured-in-place retaining walls.

It is the general object of the present invention to provide a universal multi-part form for casting parapets and the like and which is adapted to accommodate parapets which may vary substantially in vertical or end-to-end dimension and which may have either parallel or angularly displaced top and bottom surfaces.

SUMMARY OF THE INVENTION

In fulfillment of the foregoing object and in accordance with the present invention, a universal multi-part form for casting concrete parapets and the like is provided with a stationary base and support means which includes at least one substantially horizontal upwardly exposed surface for forming one of the front and rear parapet surfaces. Preferably, the front parapet surface is formed by the upwardly exposed surface of the base and support means and the rear parapet surface may be formed by conventional troweling or other means. A first or base end surface form member is mounted on the stationary base and support means and has an upwardly extending exposed inner surface which at its lower edge portion is contiguous with but in angularly relationship relative to the upwardly exposed horizontal surface of the base and support means. The base and support means and the first end surface form member may of course be so formed as to cooperatively provide any desired contour of the base portion of a parapet to be cast. For example, various groove and notch configurations can be readily provided with an upper or rear surface of the parapet exposed and the cured parapet may thereafter be raised vertically from within the form in a stripping operation.

The universal form also comprises a pair of similar but opposite side surface form members which are mounted on the stationary base and support means and which have upwardly extending exposed inner surfaces. The said surfaces at their lower edge portions are contiguous with but in angular relationship relative to the upwardly exposed horizontal surface of the base and support means and, more specifically, the surfaces conventionally are substantially at right angles with the latter surface to form the side surfaces of the parapet. The said inwardly exposed or substantially vertical surfaces of the side surface form members are, at their one or base end portions, contiguous with but in angular relationship relative to the inwardly exposed surface of the first or base end surface form. Thus, three (3) marginal surfaces, respectively a base or end surface and opposite side surfaces, of a parapet are formed with its front surface formed by the upwardly exposed horizontal surface of the base and support means.

The side surface form members are supported by the stationary base and support means for adjustable movement relative thereto and, in the presently preferred form of the invention, the said members are slidable relative to the base means in a direction substantially parallel with the upwardly exposed horizontal surface of the base means and also parallel with their own inwardly exposed surfaces. Further, the side members are preferably movable toward and away from parapet side surfaces formed thereby in a generally perpendicular direction for a form stripping operation.

A second end or top surface form member associated with the base and support means is preferably connected at its opposite end portions to the side form members at ends thereof opposite their said one end portions. The said second or top end surface form member has an upwardly extending exposed inner surface which at a lower edge portion is contiguous with but in angular relationship to the upwardly exposed horizontal surface of the base means. In most instances, the said inner surface will be in a vertical orientation and thus perpendicular to the horizontal upwardly exposed surface of the base means. The inner surface of said form member is also contiguous at opposite end portions respectively with the aforesaid inner surfaces of the said two side surface form members and, said second or top end surface form member is movable relative to the stationary base and support means and the aforesaid first or base end surface form member. Further, such movement may be in parallelism with respect to the orientation of the base form member in order to provide for parapets with top and bottom surfaces which are parallel but which vary in dimension between parapets. For parapets which have top surfaces angularly inclined relative to their bottom or base surfaces, the second or top surface form member is adapted to be adjusted to various angular positions relative to the first or base form member. Thus, parapets varying widely in end-to-end or top to bottom dimensions and, varying as to the relationship between top and bottom surfaces, parallel or angularly related, can be conveniently cast in the multi-part form of the invention. Further, a high degree of flexibility is provided in contouring the base portion of the parapets with the use of inserts or other form parts providing grooves, notches, lugs etc. On the front surface of the parapets, the form of the invention is readily adapted to provide for grooves, lugs, inserts etc. with the form adapted for vertical lifting of the parapet therefrom. On its top surface in the form, its rear surface in use, the parapet may be contoured or otherwise treated as desired. Troweling may be employed in providing flat or slightly inclined surfaces and, if steep inclines, notches, or other formations are desired, such requirements can be readily accommodated. If it is thus necessary to employ further form parts on the top or rear surface of the parapet, such form parts may be readily removed during a stripping operation and prior to raising of the parapet from the form.

DESCRIPTION OF PREFERRED EMBODIMENT

Figure 1:
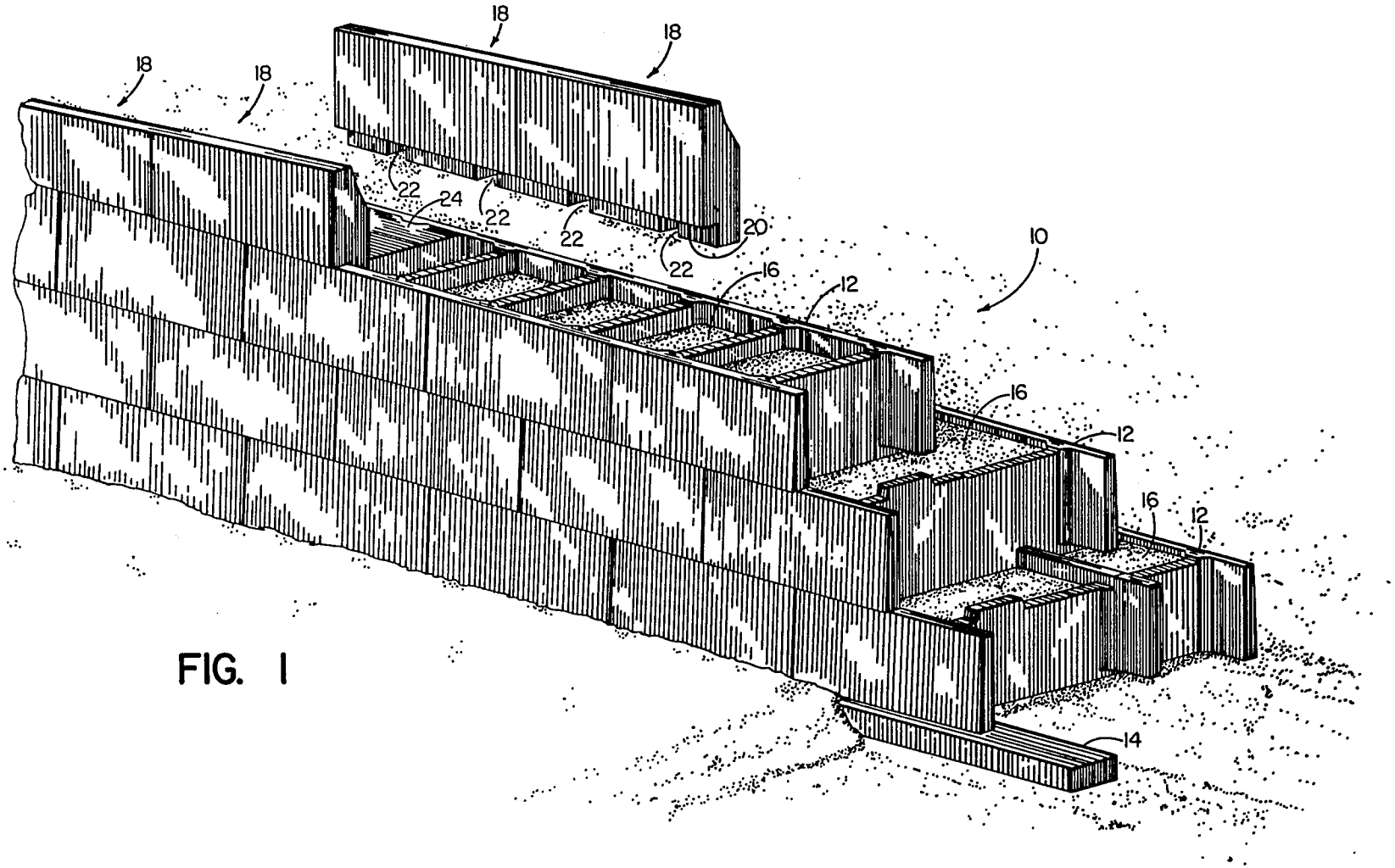
FIG. 1 is a perspective view of a highway retaining wall or the like constructed with modular DOULBEWAL units and cast concrete parapets of a type readily provided with the universal casting form of the present invention.

Referring particularly FIG. 1, it will be observed that a modular retaining wall indicated generally at 10 comprises a plurality of precast concrete structural units 12,12 stacked vertically in a staggered arrangement. The units 12,12 are of the DOUBLEWAL type and the first or lowermost course of units is elongated rearwardly and has an intermediate panel between front and rear panels while the second and third course units each have front and rear panels and integrally formed lateral connecting arms. The units may be stacked atop a simple front footing as at 14 with "fill" 16 deposed therewithin and rearwardly thereof. Reference may be had to copending U.S. patent application Ser. No. 204,327, Filed Nov. 4, 1980, on: IMPROVED PRECAST CONCRETE STRUCTURAL UNIT AND COMPOSITE WALL STRUCTURE, Inventors: Roger L. Toffolon and William L. Brown, for further details of construction of the units 12,12 and retaining walls constructed therefrom.

Mounted atop the uppermost course of units 12,12 are parapets 18,18 arranged in a longitudinal series and which may have purely aesthetic and/or functional characteristics. In an aesthetic use, the parapets 18,18 may merely top off the wall and the wall may have a staggered horizontal top surface requiring parapets of varying top-to-bottom or end-to-end dimensions or, in another aesthetic use, the parapets may have inclined top surfaces when it is required that a retaining wall be inclined downwardly from its highest point. In one example of an aesthetic and functional use of the parapets, they may serve as traffic barrier members when a road or highway is constructed approximately at the level of the uppermost course of units 12,12 and rearwardly of the parapets 18,18 in FIG. 1.

The parapets 18,18 illustrated have a longitudinally extending groove 20 at a lower portion of their front surface for receiving an upper edge portion of the front wall of DOUBLEWAL units 12,12 therebeneath. Further, notches 22,22 in the bottom surfaces of the parapets 18,18 receive the rearwardly extending connecting arms of the subadjacent doublewal units. As illustrated at 24, a poured concrete slab may be employed rearwardly of the parapets and within the cavities defined by the DOUBLEWAL units 12,12 and conventional steel reinforcement members may be used for interconnecting the parapets and the poured concrete slabs.

As will be apparent, the configuration of parapets such as 18,18 may vary widely as required by the specifications of a given construction project. While overall configuration may vary, it is nevertheless possible to at least partially standardize in certain instances in accordance with standardization of the DOUBLEWAL units 12,12. That is, the longitudinal or horizontal dimension of the parapets may be standardized in accordance with standard longitudinal or horizontal dimensions of corresponding DOUBLEWAL units. Thus, a series of standard parapets having incremental differences in such dimensions can be provided. A certain degree of standardization may also be possible with the grooves 20,20 and notches 22,22. As mentioned above, however, the vertical or top-to-bottom dimensions of the units may vary substantially even in a specific construction project, this including both parapets having parallel top and bottom surfaces and parapets having angularly related top and bottom surfaces. Front and rear parapet configurations may also vary widely in accordance with particular specifications and individual preferences.

Figures 2, 3:
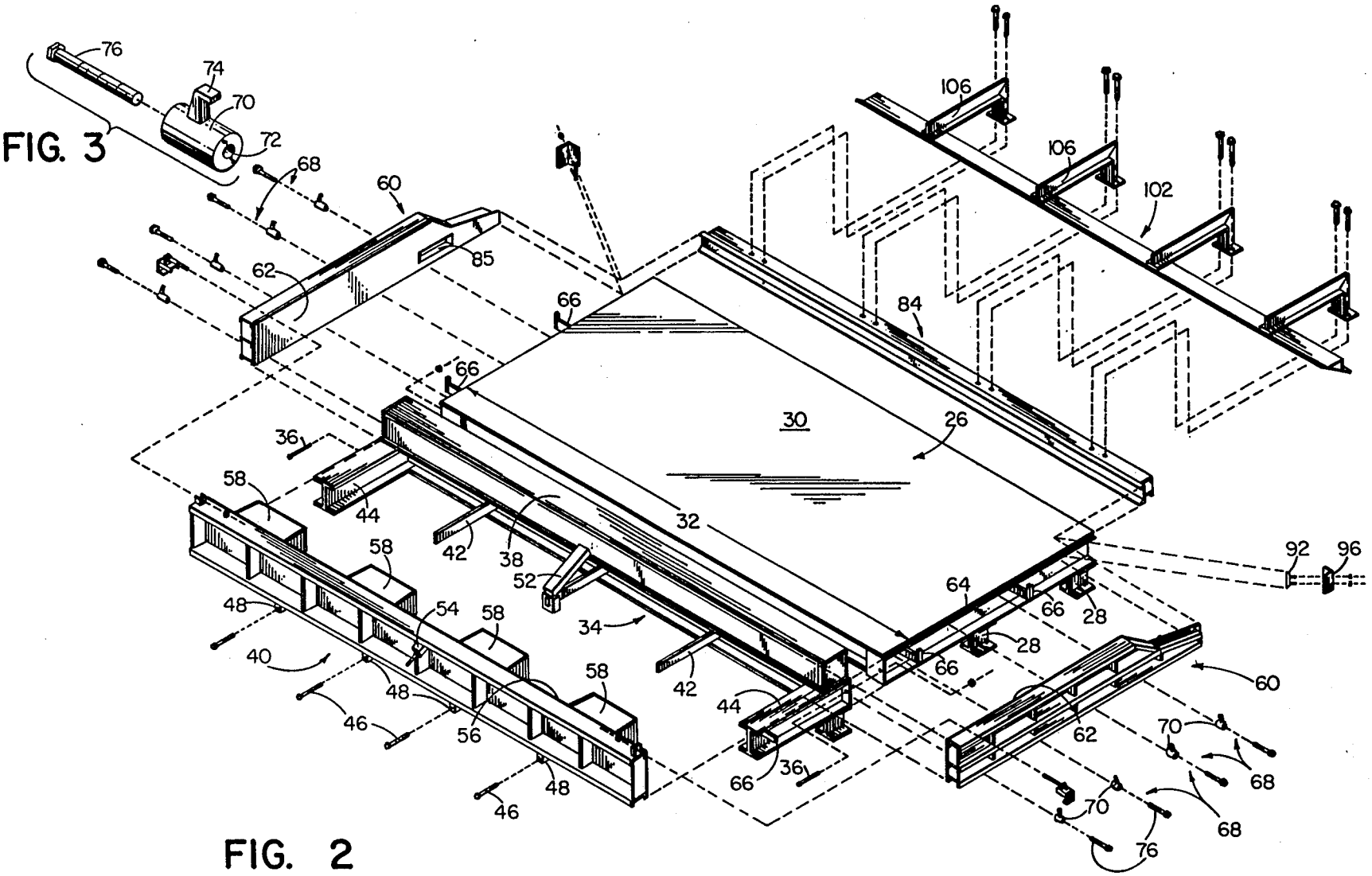
FIG. 2 is an exploded perspective view of a universal multi-part form constructed in accordance with the present invention.
FIG. 3 is an enlarged perspective view showing a representative latching member employed in securing side form members in position on a stationary base and support portion of the multi-part form.
Figure 4:
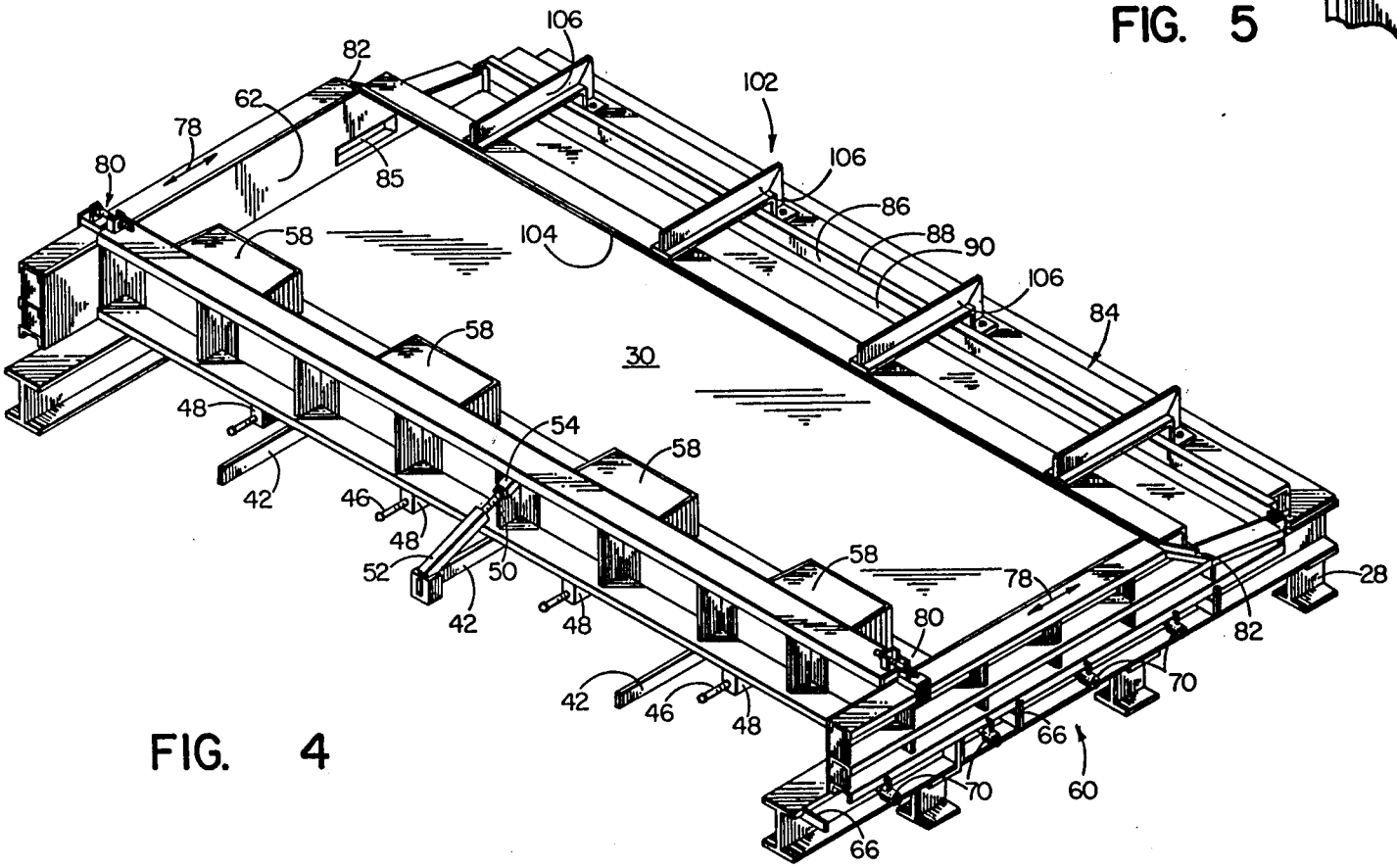
FIG. 4 is a perspective view showing the multi-part form of FIG. 2 in assembled relationship and in a ready condition for casting a parapet or the like in the cavity therewithin.

The universal form of the present invention is adapted for a parapet of a given length, longitudinal or horizontal dimension in FIG. 1, but is otherwise readily adaptable to wide variation in parapet configuration. As best illustrated in FIGS. 2 and 4, the form of the present invention comprises a stationary base and support means which is illustrated as having two parts in FIG. 2. A first part of the base means indicated generally at 26 takes the form of a pallet or base plate which is supported on stub legs 28,28 and which defines a substantially horizontal upwardly exposed surface 30 which is adapted to form one of the front and rear surfaces of a pallet. As shown, the surface 30 is adapted to form the front face of a parapet 18 as illustrated in FIG. 1 and is planar in configuration. Obviously, the surface 30 may be otherwise configured as desired for parapets having front or rear faces other than planar in configuration. The dimension 32 of the surface 30 corresponds to the length, longitudinal or horizontal parapet dimension in FIG. 1, and is fixed for a given form. Substantially all other dimensions may be readily changed.

A second part 34 of the base and support means is shown separate from the part 26 but connectable therewith by means of a series of small connecting bolts 36,36. The form part 34 may be referred to as an end or bottom bulkhead and includes a substantially rectangular upstanding member 38 which defines the groove 20 in a parapet 18. Thus, the bulkhead 34 may be said to partially define an end or bottom wall and to partially define a front surface of the parapet.

A first end surface form member in accordance with the invention may take the form of a second end or bottom bulkhead 40. The bulkhead 40 is mounted on the base and support means, and more particularly, is supported by rails 42,42 and I-beam frame members 44,44, FIG. 4. Slight movement of the bulkhead 40 toward and away from the form members 26,34 is accommodated by the rails 42,42 and frame members 44,44. Thus, the bulkhead 40 may be secured in assembled position as in FIG. 4 for casting and thereafter moved slightly outwardly or away from the members 26,34 in a stripping operation. Bolts 46,46 and small apertured lugs 48,48 on bulkhead 40 serve as tie and stripping means. That is, some of the bolts and lugs may be arranged to tie the bulkhead in position with the bolts entering suitably threaded openings not shown in the form member 34. Other of the bolts 46,46 may be entered in threaded openings in the lugs 48,48 and merely engage surfaces on the form member 34 at their inner end portions. Thus, the latter bolts can be employed in urging the bulkhead 40 slightly outwardly and away from a cast parapet in order to facilitate seal breaking and the form stripping operation.

The bulkhead 40 is normally positioned in a substantially vertical attitude but may be adjusted for slight angles of inclination by means of a lead screw 50 connected between the bulkhead and a central or intermediate support rail 42. Thus, the lead screw 50 may be rotated and locked in position relative to screw receiving member 52,54 to establish an angle of inclination for the bulkhead 40 as may be required.

The bulkhead 40 has an upwardly extending exposed inner surface 56 which at a lower edge portion is contiguous with but in angular relationship relative to the upwardly exposed horizontal surface 30. The surface 56 extends between and beneath notch or lug forming projections 58,58 but is inoperative in the form shown as it is disposed behind the groove forming member 38. That is, the lug or notch forming projections 58,58 are disposed above the member 38 so as to present their inner and side surfaces to the mold cavity in cooperation with the inner and top surface of the member 38. The notches formed in a parapet 18 by the projections 58,58 appear at 22,22 in FIG. 1.

A pair of similar but opposite side surface form members are mounted on the assembled base and support means 26,34 and may take the form shown at 60,60. The side form members 60,60 have upwardly extending exposed inner surfaces 62,62 which at lower edge portions are contiguous with but in angular relationship relative to the upwardly exposed surface 30. At one end portion each of the surfaces 62,62 is contiguous with but in angular relationship relative to the inwardly exposed surface of the member 38 and bulkhead 40. The side form members 60,60 are supported by a narrow shoulder 64 on the pallet 26 and by outwardly projecting support rails 66,66.

Latching means as at 68,68 secure the side members 60,60 in assembled position and may vary widely in form. As shown, and as best illustrated in FIG. 3 showing a single enlarged latching means, a small cylindrical member 70 may be provided with a through opening 72 and a latch member 74. A bolt 76 entered through the opening 72 and engaged in a suitable threaded opening in the pallet 26 can be employed to secure the latch member 74 in firm engagement with a lower edge portion of a side form member 60. Thus, the several latching means 68,68 can be used to secure the side members against movement in all directions relative to the base and support means 26,34. When released, with the bolts 76,76 drawn outwardly, the latch means permit movement of the side form members and such movement may be effected in two directions. First, the side members may be moved in a direction parallel to the plane of the surface 30 and away from the pallet 26 in a form stripping operation. Secondly, the members 60,60 are movable in a direction parallel to the surface 30 and also parallel to their own inner surfaces 62,62 along the side edges of the pallet 26. That is, the side form members may be moved in the directions indicated by the arrows 78,78 in FIG. 4 relative to the base and support means 26,34 and the bulkhead 40. Release of a further latching or locking means is required in such movement of the side members and such means is illustrated at 80,80. The latching or locking means 80,80 secure the side member 60,60 to the bulkhead 40 and may take the form of a pair of small brackets respectively engaging the side members and the bulkhead and an interconnecting bolt and nut arrangement. As will be apparent, all latching and locking means including the means 68,68 and 80,80 are adapted for relative sliding movement of the side form members 60,60.

The sliding movement of the side form members 60,60, as distinct from their form stripping movement, is employed in dimensioning parapets such as a parapet 18. That is, the members 60,60 may be moved upwardly and rightwardly from the positions shown in FIG. 4 to provide a parapet 18 having an increased end-to-end or bottom-to-top dimension. Similarly, with the side form members moved in unison downwardly and leftwardly the form can be readily adapted for a parapet having a decreased top-to-bottom dimension. Still further, and as will be seen hereinbelow, the side form members 60,60 can be moved to provide for parapets having angularly related top and bottom surfaces.

The top surface contours of the side form members 60,60 may of course vary widely within the scope of the invention. As illustrated, the members 60,60 are adapted to the formation of parapets such as the FIG. 1 parapet 18 with a relatively thick lower portion between the bulkhead 40 and a chamfer section near the top of the parapet. Accordingly, a chamfer section is provided at 82,82 on the side form members at an appropriate location along their length. Lug and notch interconnection of parapets is preferred although not shown in FIG. 1. Accordingly, a lug is provided at one end of a parapet as illustrated by the small recess 85 in an upper lefthand portion of the form in FIG. 4. A corresponding notch forming projection, not shown, may be provided on an inner surface of the lower righthand side form member 60 in FIG. 4.

A second or top end surface form member associated with the base and support means 26,34 is illustrated in exploded form in FIG. 2 at 84, and in assembled position at 84 in FIG. 4. The second or top form member 84 is connected at opposite end portions by means to be described with the side form member 60,60 and, as shown in FIG. 4, is disposed atop the pallet 26 and its exposed surface 30. Thus, the top form member is adapted to be moved in unison with the side form members 60,60 and its position relative to the bulkhead 40 is determinative of the height or top-to-bottom dimension of a parapet cast in the form. The member 84 has an inwardly exposed surface 86 which at a lower edge portion is contiguous with but in angular relationship to the horizontal surface 30 and which at opposite end portions is contiguous with but in angular relationship relative to the side form surfaces 62,62. Preferably and as shown the surface 86 is substantially vertical and a pair of fillet members 88 and 90 are provided at upper and lower edge portions thereof for the formation of small chamfer surfaces at front and rear portions of the top surface of a parapet 18.

Figure 5:
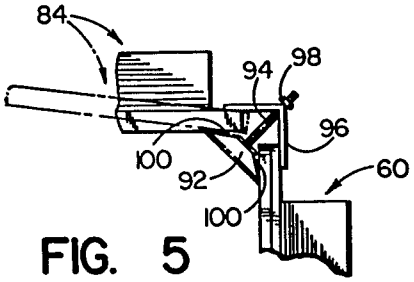
FIG. 5 is an enlarged fragmentary view showing a portion of one corner of the form and a corner filler member associated therewith and adaptable to various corner angles.

As best illustrated in FIG. 5, a connection between the top form member 84 and the side form members 60,60 is preferably effected by means of small corner filler members which respectively cover the interior of the joint line between the side and end form members. A single representative member is shown in FIG. 5 at 92 with a representative bolt 94 extending angularly rearwardly or outwardly therefrom to a corner bracket 96. The corner bracket 96 is apertured to receive one or more bolts 94 and associated nuts 98,98 secure the filler member 92 and the bracket 96 in clamping position whereby to secure one corner connection between a side member 60 and the top form member 84.

As will be observed, the corner filler member 92 has inclined surfaces 100 which are somewhat in excess of forty-five degrees whereby to adapt to a perpendicular corner connection of the form members and also to tightly close a connection of such form members somewhat exceeding the perpendicular. As illustrated in FIG. 5 the top form member 84 is inclined from a right angular relationship with its adjacent side form member 60 for the formation of a parapet 18 with an inclined top surface. That is, the righthand side form member 60 in FIG. 4 may be moved downwardly and leftwardly relative to the lefthand side form member 60 to bring the form members to the relative positions shown in FIG. 5 at the upper righthand connection or corner between the members. Obviously, the connection between the top member 84 and the upper or lefthand side form member 60 will occur at an angle less than ninety degrees and such angular connection is accommodated by the corner filler members 92,92. Still further, it will be obvious that a high degree of flexibility in corner connection is provided for with the filler members 92,92 and brackets 96,96. Right angle connections can be readily provided for and other angles departing substantially from the perpendicular can also be accommodated.

When the form of the present invention is employed in casting a parapet, the casting cavity provided by the several form members is filled in a conventional manner and troweling may then be accomplished on the top surface of the concrete mix. Contours other than a simple flat or planar configuration can be provided within limits in the troweling operation but when relatively sharp contours are required it may be desirable to provide a contour form member such as the member 102. The member 102 is adapted to form the chamfer on a parapet 18 and has an inclined bottom surface 104 providing the desired contour and complimenting the inclined surfaces 82,82 on the side form members 60,60. As shown, the contour form member 102 is supported by and is movable with the top form member 84 in a cantilever arrangement with overhang frame members 106,106 secured to the top frame member 84. Obviously, various other contour form members may be provided and may for example be secured to and supported from other form members such as the bulkhead 40.

As will be apparent from the foregoing, the universal form of the present invention provides for a high degree of flexibility in the casting of parapets and the like. A wide variety of parapets varying in dimension and configuration can be accommodated in a single form. Moreover, the ease and convenience of casting and subsequent stripping is enhanced with the form of the present invention. Seals may be broken readily in a stripping operation by means of slight movement of the various form members as described above. Further, it will be noted that a slight sliding movement of the side members 60,60 in an upward and rightward direction in FIG. 4 will result in a stripping operation of the top form member 84 relative to a parapet which has been cast and cured in the cavity of the form. Conventional lift means may be employed with the contour form member 102 removed in a vertical lifting operation of the parapet subsequent to the form stripping movements and a subsequent casting operation may then proceed with a rapid and convenient tieing or reassembly operation of the form. When it is desired to change parapet configuration, all necessary form adjustments may be carried out in an efficient and convenient operation.

I claim:

1. A universal multi-part form for casting concrete parapets, the parapets each having front and rear surfaces and opposite side and end surfaces with the dimensions between end surfaces varying between parapets; the form comprising a stationary base and support means including at least one substantially horizontal upwardly exposed surface for forming one of said front and rear parapet surfaces, a first end surface form member mounted on said stationary base and support means and having an upwardly extending exposed inner surface which at a lower edge portion is contiguous with but in angular relationship relative to said upwardly exposed horizontal surface, a pair of similar but opposite side surface form members mounted on said stationary base and support means and having upwardly extending exposed inner surfaces which at lower edge portions are contiguous with but in angular relationship relative to said upwardly exposed horizontal surface and which at one end portion are respectively contiguous with but in angular relationship relative to said inwardly exposed surface of said first end surface form, each of said side surface form members being supported by said stationary base means for adjustable movement relative thereto in a direction substantially parallel with the upwardly exposed horizontal surface of said base means, and a second end surface form member associated with said stationary base and support means and said side surface form members at end portions of the latter opposite their said one end portions, said member having an upwardly extending exposed surface which at a lower edge portion is contiguous with but in angular relationship relative to said upwardly exposed horizontal surface of said base means, said inner surface also being contiguous at its opposite end portions respectively with said inner surfaces of said two side surface form members at their said opposite end portions, said second end surface form member being movable relative to said stationary base and support means and said first end surface form member whereby to accommodate parapets of varying dimensions between their opposite end surfaces, and each of said side surface form members being adapted for adjustable movement in a direction substantially parallel with its own exposed inner surface, and releasable securing means provided in association with each of said side surface form members for securing said members in selected positions relative to said stationary base and support means, said selected positions being the same relative to said first end surface form member and substantially different from each other relative to said first end surface form member whereby respectively to provide parapets with parallel end surfaces and parapets with angularly related end surfaces.

2. A universal multi-part form for casting concrete parapets and the like as set forth in claim 1 and including a pair of similar small corner filler members respectively for the joint areas between said side surface form members and said adjustable second end surface form member, each of said members being adapted to cover the interior of the joint line between said side and end form members and further adaptable to both perpendicular internal corner surfaces and internal corner surfaces which depart substantially from the perpendicular.

3. A universal multi-part form for casting concrete parapets and the like as set forth in claim 1 wherein said side surface form members are slidably mounted respectively along opposite side sections of said stationary base and support means, and wherein said releasable securing means comprises first and second groups of latching members respectively associated with said side form member and each engageable with said base and support means.

4. A universal multi-part form for casting concrete parapets and the like as set forth in claim 3 wherein said first end surface form member is mounted on said stationary base and support means for movement relative thereto and in a direction generally perpendicular to its said exposed inner surface, and wherein said form member is provided with tie and strip means operatively associated with said base and support means and respectively serving to secure the member to the base and support means in assembled position for casting and to urge the member to an outer and disassembled position relative to said base and support means in a form stripping operation.

5. A universal multi-part form for casting concrete parapets and the like as set forth in claim 4 wherein said first end surface form member is provided with an angular adjustable means for varying the angle of its said exposed inner surface relative to the upwardly exposed surface on said base and support means.

6. A universal multi-part form for casting concrete parapets and the like as set forth in claim 1 wherein said second end surface form member is releasably connected at its opposite end portions respectively with said opposite end portions of said side surface form members and is slidably supported on said upwardly exposed surface of said base and support means, said end surface form member thus being movable away from the corresponding end surface of a cast parapet in a stripping operation on movement of the side surface form members in a direction toward said parapet end surface.

7. A universal multi-part form for casting concrete parapets and the like as set forth in claim 6 wherein said side surface form members are mounted on said base and support means for stripping movement in a direction generally perpendicular to the side surfaces of a parapet cast thereby.

8. A universal multi-part form for casting concrete parapets and the like as set forth in claim 6 wherein said side surface form members have upper edge surface varying in contour from end-to-end, and wherein a contour form member at least partially conforming to said contour is provided therebetween.

9. A universal multi-part form for casting concrete parapets and the like as set forth in claim 8 wherein said contour form member is supported in cantilever fashion from one of said end surface form members.

10. A universal multi-part form for casting concrete parapets and the like as set forth in claim 9 wherein said contour form member is supported in cantilever fashion from said second and movable end surface form member.

* * * * *